United States Patent [19]

Arena

[11] Patent Number: 4,478,114

[45] Date of Patent: Oct. 23, 1984

[54] WRENCH WITH OVERCENTER LINKAGE

[76] Inventor: Aldo Arena, 3 Lonni Lane, Smithtown, N.Y. 11787

[21] Appl. No.: 426,672

[22] Filed: Sep. 29, 1982

[51] Int. Cl.[3] ..... B25B 13/26; B25B 7/12

[52] U.S. Cl. ..... 81/363; 81/369; 81/372; 81/373; 81/126

[58] Field of Search ..... 81/352-353, 81/355-356, 362-363, 367-384, 126, 128, 129, 175, 57.39

[56] References Cited

U.S. PATENT DOCUMENTS

| | | | |
|---|---|---|---|
| 952,074 | 3/1910 | McIntire | 81/363 X |
| 2,280,005 | 4/1942 | Petersen | 81/363 X |
| 2,428,949 | 10/1947 | Ward et al. | 81/367 |
| 2,496,308 | 2/1950 | Pugh et al. | 81/384 X |
| 2,514,130 | 7/1950 | Jones | 81/384 X |
| 2,589,511 | 3/1952 | Redmon | 81/370 |
| 3,564,956 | 2/1971 | Landen | 81/126 |
| 4,174,646 | 11/1979 | Kotler | 81/128 |
| 4,300,415 | 11/1981 | Saila | 81/363 X |

FOREIGN PATENT DOCUMENTS

| | | | |
|---|---|---|---|
| 1086189 | 7/1960 | Fed. Rep. of Germany | 81/379 |
| 688328 | 3/1953 | United Kingdom | 81/363 |

*Primary Examiner*—Frederick R. Schmidt
*Assistant Examiner*—Debra S. Meislin
*Attorney, Agent, or Firm*—Marius J. Jason

[57] ABSTRACT

A wrench is formed of two jaws which are shaped to conform to standard fasteners, such as hex nuts, and are supported within a housing for translation relative to each other for gripping the fastener. Closing force on the jaws is exerted by a pivoting handle acting through an overcenter linkage. A crank-shaped lever is positioned contiguous to the overcenter linkage permits operation of the wrench with the jaws being either tightly clenched or slightly withdrawn from the fastener. One end of the overcenter linkage is connected to the housing by a screw which is rotated to set a spacing between the jaws.

4 Claims, 12 Drawing Figures

WRENCH WITH OVERCENTER LINKAGE

BACKGROUND OF THE INVENTION

This invention relates to wrenches and, more particularly, to wrenches employing translatable jaws preformed to mate with a fastener or other object to be gripped, the jaws being driven by an overcenter linkage and a pivoting handle.

It is common practice in manufacturing processes, such as those utilizing fasteners including hex nuts and hex bolts, to hold the fasteners with open end or box wrenches of fixed size, or to hold the fasteners with an adjustable wrench having pivoting biting jaws which may be actuated via an overcenter linkage as shown in the U.S. Pat. No. 2,280,005 of Peterson.

In either the fixed or adjustable form of wrench, a problem arises in that the gripping of the fastener, or other object which is to be gripped, is accomplished in a less than optimal fashion. If a fixed preformed wrench, such as the open-end wrench for hex nuts, is employed, then a different sized wrench is required for each size of fastener which is to be utilized in a manufacturing process. If a wrench with adjustable biting jaws is employed, the teeth of the jaws may slip about the fastener or may gouge the surface of the fastener.

SUMMARY OF THE INVENTION

The foregoing problem has been overcome and other advantages are provided by a wrench constructed in accordance with the invention to provide translatable preformed jaws which accommodate fasteners of differing sizes and incorporates an overcenter linkage to provide a tight clenching of the jaws when desired. In the present invention it has been discovered that squeeze forces applied through grip jaws which are shaped to accommodate fasteners, such as hex-head fasteners and fasterners having other shapes, permit a more positive application of torque without fear that the jaws may slip. Such slipping can occur with open-end or box wrenches presently in use. In addition, the squeeze forces facilitate removal of rust encrusted fasteners, increase safety of work in close quarters by assuring that a tool employing the invention will not slip, and also facilitate the emplacement of nuts and bolts in close quarters while reducing the possibility of damage to the fasteners by the jaws. Thus, by utilizing jaws which are shaped to mate with the fasteners in combination with the mechanical advantage of the overcenter linkages, the present invention offers innovations over presently available wrenches.

In the construction of the invention, one jaw is fixedly mounted to a housing while a second jaw is slidably mounted within the housing so as to be adjustably positioned relative to the fixed jaw. The second jaw is moved by a pivoting handle connected to the housing through the overcenter linkage. The surfaces of the jaws which engage a fastener are maintained in parallel relation for all positions of the second jaw so as to accommodate fasteners of different sizes. This is a distinct advantage over many wrenches, presently available commercially, which employ pivoting jaws actuated by an overcenter linkage. As a result, the jaws can mate with fasteners of differing sizes but having the same shape. A further feature is the inclusion of a crank-shaped lever which may be operated to offset the overcenter linkage to slightly retract the jaws from the fastener to provide a grip similar to that of a box wrench.

Alternatively, the crank-shaped lever may be operated to permit the clenching of the jaws about the fastener as is desirable in the case of rusted fasteners.

BRIEF DESCRIPTION OF THE DRAWING

The aforementioned aspects and other features of the invention are more fully explained in the following description taken in connection with the accompanying drawing wherein.

DETAILED DESCRIPTION

Figure 1:
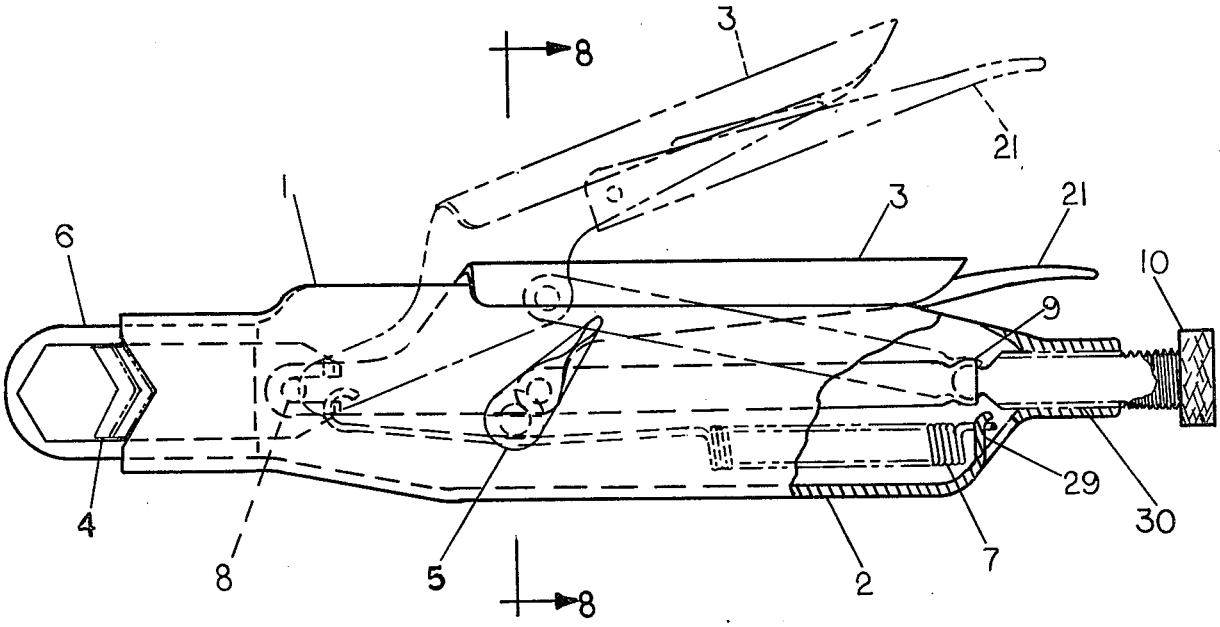
FIG. 1 is a side elevation view, partly broken away and sectioned, of the wrench of the invention.
Figure 8:
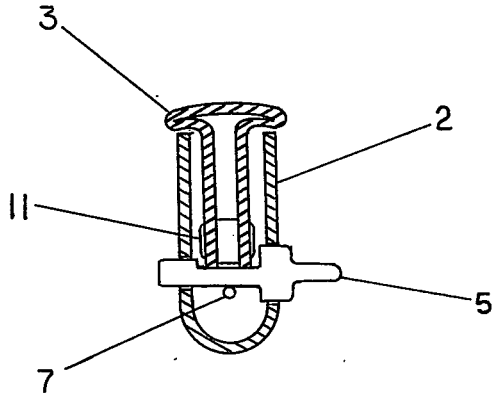
FIG. 8 is a sectional view taken along the line 8—8 in FIG. 1.
Figure 9:
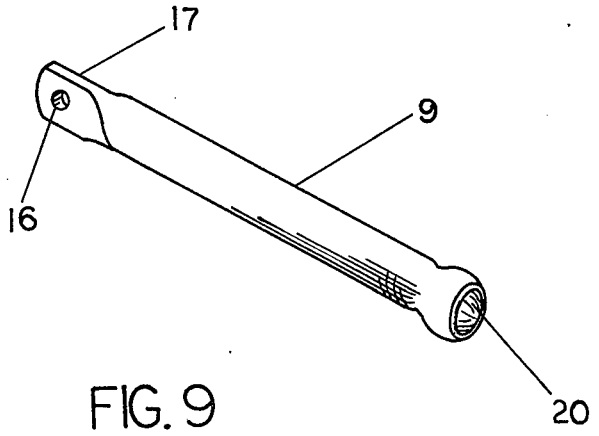
FIG. 9 is a perspective view of a rod-shaped link of the overcenter linkage.
Figure 10:
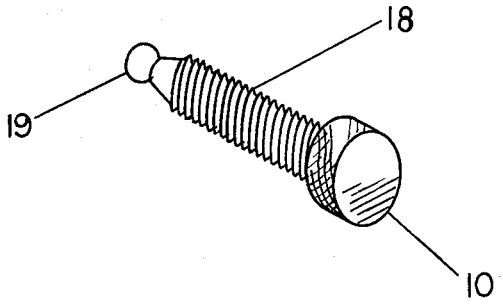
FIG. 10 is a perspective view of an adjustment screw which connects with the link of FIG. 9.

FIG. 1 shows a wrench 1 incorporating the invention and constructed in accordance with a preferred embodiment of the invention, the components of the wrench 1 being shown in the succeeding FIGS. 2–10. As shown in the figures, the wrench 1 comprises a housing 2, a handle 3, a male jaw 4, a lever 5, a female jaw 6, a spring 7, a pin 8 (FIG. 1), a link 9, a screw 10, and a pin 11 (FIG. 8). The forward end of the handle 3 connects with the jaw 4 by means of the pin 8 which is inserted through an aperture 12 in each of two tangs 13 of the handle 3, and through a slot 14 in the jaw 4. The handle 3 is secured to the forward end of the link 9 by the pin 11 which is inserted through apertures 15 in the tangs 13, and through an aperture 16 in a tongue 17 of the link 9. The back end of the jaw 4 and the tongue 17 of the link 9 fit between the tangs 13 of the handle 3. The jaw 4 slides within the forward end of the housing 2 which is formed as a guide about the jaw 4 and female jaw 6. The screw 10 is secured by threads 18 to the back end of the housing 2 which is formed as a threaded cylinder, the forward end of the screw 10 being connected by a ball and socket 19 and 20 to the back end of the link 9.

In accordance with the invention, the surfaces of the jaws 4 and 6 which contact the object to be gripped are provided with a predetermined shape to mate with the surface of the object. In particular, in the case of fasteners such as nuts and bolts which are to be gripped by the jaws 4 and 6, the edge of each jaw surface is a fraction of a hexagon so as to mate with the hexagonally shaped nuts and bolts. In the event that an object of pentagonal shape is to be gripped, the jaws are configured accordingly with a pentagonl edge. The shapes of the jaws are symmetrical about their respective centerlines so that, upon displacement of the jaws to accommodate various sizes of fasteners having a common shape, the jaws 4 and 6 still mate with the fastener.

The sliding of the male jaw 4 within the housing 2 and female jaw 6 maintains a parallel orientation of the gripping surface of the male jaw 4 relative to that of the female jaw 6 which is rigidly secured to the housing 2. Thereby, the wrench 1 can accommodate fasteners of various sizes. The overcenter linkage provides for a strong gripping force which urges the male jaw 4 against the female jaw 6 to securely grip the fastener or other object upon a closing of the handle 3 toward the housing 2. As the handle 3 pivots about the pin 8 toward the housing 2, the tangs 13 are brought toward parallel relation with the link 9 to drive the jaws together.

FIG. 1 shows the handle 3 with the link 9 pivotably connected thereto by the pin 11 (FIG. 8) in both the closed position as well as in the open position, the open position being presented in phantom view. During the pivoting of the handle 3 about the pin 8, the link 9 pivots about the ball 19 of the screw 10. Thereby, an overcenter linkage is provided by the interconnection of the handle 3 and the link 9. An optional lever 21 (FIG. 1) may be affixed by conventional means to the handle 3 to overcome forces of the overcenter linkage to facilitate opening of the handle 3 from the housing 2 when it is desired to release the grip of the wrench 1.

In accordance with a further feature of the invention, the lever 5 may be operated to permit full exertion of the clamping force by the overcenter linkage or, alternatively, may be operated to slightly retract the jaws 4 and 6 while allowing the handle 3 to be in substantially the same position. Thereby, with the alternative operation of the lever 5, the wrench 1 may be employed as a box wrench without exertion of the clamping force by the jaws in gripping a fastener. Of course, the lever 5 serves to facilitate opening the handle 3 from the housing 2, since by releasing the forces exerted by the overcenter linkage, the handle 3 is readily moved to the open position.

Figure 2:
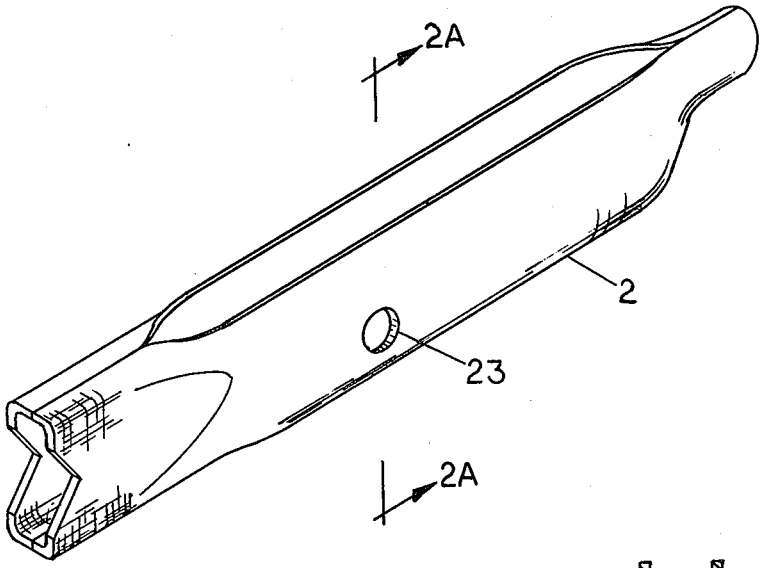
FIG. 2 is an isometric view of a housing of the wrench of FIG. 1.
Figure 2A:
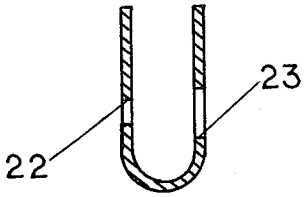
FIG. 2A is a sectional view taken along the line 2A—2A in FIG. 2.
Figure 3:
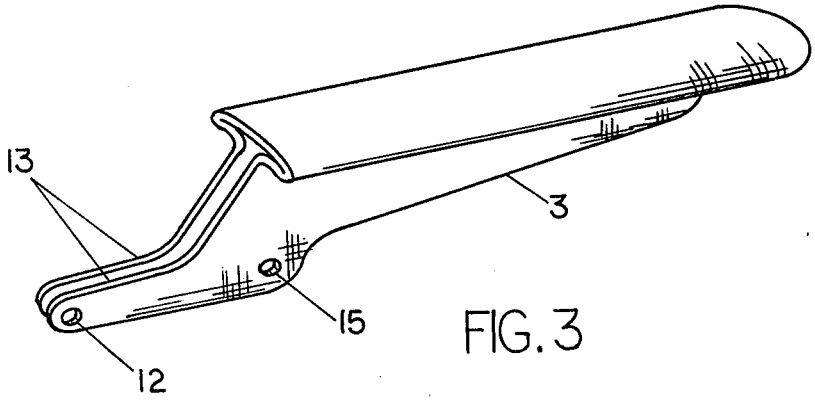
FIG. 3 is a perspective view of a handle of FIG. 1 which serves as part of an overcenter linkage by which claaping forces are applied.
Figure 4:
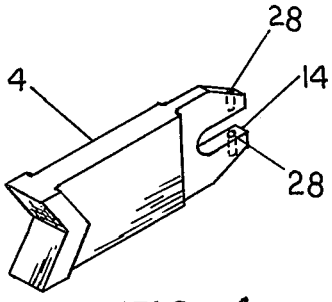
FIG. 4 is an isometric view of the male jaw of the wrench of FIG. 1.
Figure 5:
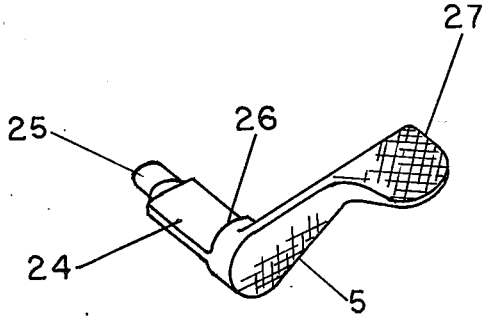
FIG. 5 is an isometric view of a release lever, in the form of a crank, for the overcenter linkage.
Figure 6:
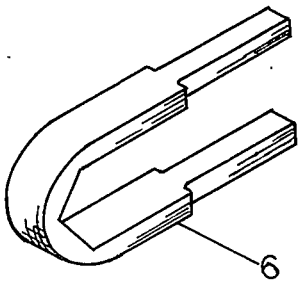
FIG. 6 is an isometric view of the female jaw of the wrench.
Figure 7:
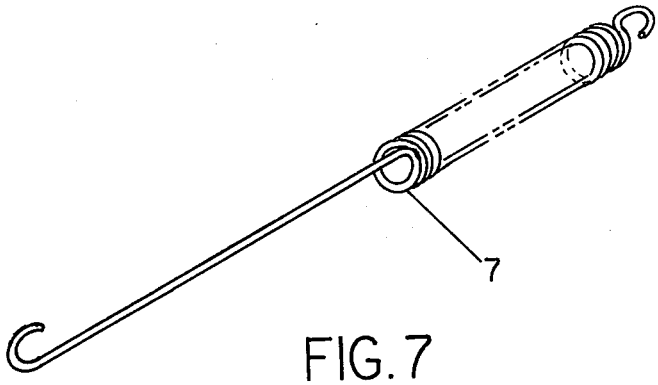
FIGS. 7 and 7A show alternative configurations of a jaw return spring of the wrench.
Figure 7A:
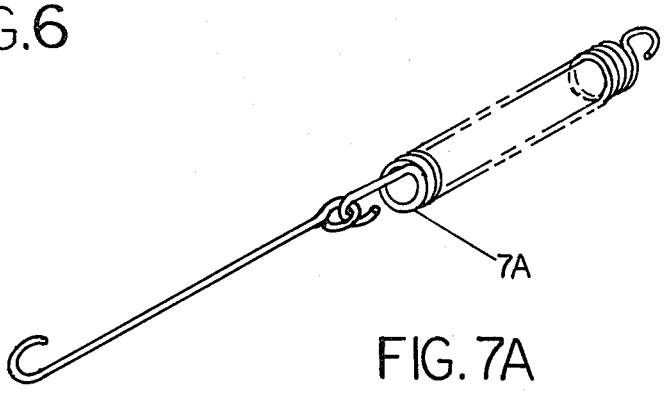

The lever 5 is supported within apertures 22 and 23 (FIG. 2A) in the sidewall of the housing 2, the apertures 22 and 23 being located for positioning the lever 5 alongside the forward end of the link 9 and bottom side of handle 3. The lever 5 (FIG. 5) comprises a cam 24 formed of a flat shaped mid-portion of the lever, there being a stub shaft 25 of smaller diameter and a stub shaft 26 of larger diameter extending from opposite ends of the cam 24. The shaft 25 rests within the aperture 22 and shaft 26 rests within the aperture 23, the aperture 23 being larger than the aperture 22 to accommodate the difference in shaft diameter. A thumb grip 27 extends from the larger stub shaft 26 perpendicularly to the common axis of rotation of the shafts 25–26, whereby the lever 5 is rotated. With rotation of the lever 5, its cam 24 can position the link 9 for the alternative modes of operation of the wrench 1.

With either mode of operation, the spring 7, or alternatively the spring 7A, pulls the jaw 4 towards the back end of the housing 2 to facilitate release of the grip of the wrench 1. The forward end of the spring 7 or 7A is shaped as a hook for setting within a through hole 28 (FIG. 4) near the end of the slot 14 of the jaw 4, while the back end of the spring 7 or 7A hooks around a tang 29 projecting from the back end of the housing 2.

Continuing further with the description of the construction of the wrench 1 and the benefits derived therefrom, the female jaw 6 may be fabricated of steel, preferrably drop-forged for added strength. The jaw 6 is secured to the housing 2 after prior insertion of the male jaw 4, the securing being accomplished preferrably by brazing. The construction of FIG. 1 is advantageous in that the jaw 6 can be easily located by banking against the housing 2 without a need of locating fixtures to maintain proper jaw opening during the brazing operation. The housing 2 is shaped to accept the jaw 6 with enough space to allow the flow of brazing material between the housing 2 and the female jaw 6. In the connection of the handle 3 to the male jaw 4, the pin 8 is preferrably fabricated as a rivet which is pre-assembled to the tangs 13 of the handle 3, the pin 8 then being slid into the slot 14 of the jaw 4. This method of engagement is advantageous in that it can be done following the brazing of the jaw 6 to the housing 2. A further advantage of the construction is found in the insertion of the forward end of the spring 7 in the through hole 28 of the jaw 4 since the inserted spring blocks the pin 8 from backing out of the slot 14 in the jaw 4.

The diameter of the screw 10 at the threads 18 and the corresponding diameter of the threaded cylindrical portion 30 are larger than the diameters of the ball 19 and of the link 9 including its socket 20 so that the link 9 can be inserted into the housing 2 via the threaded portion 30 after the connecting of the link 9 to the screw 10. The connecting may be accomplished by swaging the socket 20 to the ball 19.

The overcenter release lever 5 is inserted into the housing 2 via the larger aperture 23, the aperture 23 being sufficiently large to clear the cam 24. The smaller aperture 22 which receives the stub shaft 25 is too small to admit passage of the cam 24 which, therefore, butts up against the sidewall of the housing 2 for positioning the lever 5 within the housing 2. The lever 5 is secured to the housing 2 by a snap ring (not shown) or other conventional retaining device such as a hat cap (not shown) attached to the shaft 25.

In operation, the spring 7 rests against the lever 5, upon the flat surface of the cam 24, so that the lever 5 will be spring loaded to a rest position wherein the flat surface of the cam 24 is parallel to the long axis of the housing 2. In the rest position, the lever 5 permits the overcenter linkage of the handle 3 and the link 9 to reach the overcenter position. The amount of overcenter displacement is controlled by the positioning of the lever 5 relative to the housing 2. When the lever 5 is depressed by finger force, a camming action is generated which lifts the overcenter linkage, thereby releasing the wrench from the overcenter position and allowing the spring 7 to pull back the jaw 4 for releasing an object held fast between the jaws 4 and 6. Small protrusions (not shown) in the housing 2 aid in holding the lever 5 in an alternate position reached by rotation of the lever 5 through an angle of 90° when it is desired to so rotate the lever. The protrusions serve as a detent. Alternatively, the undersurface of the cam 24 may be extended radially outward from the axis of rotation of the lever 5 so as to lift the overcenter linkage for relasing the grip of the wrench 1 upon rotation of the lever 180° from the rest position. This alternative embodiment of the cam 24 is advantageous in that pressure of the spring 7 can hold the wrench 1 in the unlocked position, in which case the aforementioned detent at 90° would not be required.

When the lever 5 is held in either of the foregoing two positions of unlock, the overcenter linkage cannot reach the locked or overcenter position, and the wrench 1 is held in the unlocked position by a hand gripping force on the handle 3 since spring 7 tends to open the wrench. Upon release of the handle 3, the handle 3 springs open under the force of the spring 7 to open the jaws. Thus, with the lever in the 90° or the 180° position, the foregoing feature provides the advantage of quick grip and release action without the need to actuate the lever 5.

Moreover, the crank shaped lever 5 permits the jaws to maintain the same proximity, however in one position of the release lever, the handle 3 and overcenter linkage 9 are permitted to reach the overcenter position. With a fastener gripped between the jaws, the gripping force tends to drive the handle 3 and the linkage 9 further in the overcenter direction with the release lever 5 acting as a stop and controlling the amount of overcenter displacement. With the release lever at either a 90° or 180° position, the handle 3 and the linkage 9 are prevented from reaching the overcenter position, and while the same proximity of jaws 4 and 6 can be achieved with the lever 5 in the 180° position, the clinching loads tend to open handle 3 and such loads must be resisted by a hand force on the wrench. Upon releasing the hand force, the clinching forces cause the handle 3 to open with the aid of spring 7 thereby resulting in a quick release feature.

The foregoing features of jaws preformed to mate with fasteners, in combination with the overcenter linkage, provide a number of advantages. Damage to fasteners, particularly rusted fasteners, is avoided since there are no teeth in the jaws which might bite into the fastener surface. Also, there is increased safety since the wrench is less likely to slip off from a fastener and possibly fall on nearby personnel.

It is to be understood that the above-described embodiments of the invention are illustrative only and that modifications thereof may occur to those skilled in the art. Accordingly, this invention is not to be regarded as limited to the embodiments disclosed herein, but is to be limited only as defined by the appended claims.

What is claimed is:

1. A wrench comprising:

a housing with a jaw fixed at one end thereof;

a handle having two portions with a pin therebetween and extending inside said housing and movable with respect to said housing;

a second jaw slidably mounted within said housing, said housing being structured for guiding said second jaw towards said fixed jaw for gripping an object, said second jaw having a slot therein in which said pin is disposed;

each of said jaws having surfaces configured for mating with said object upon contact with said object;

overcenter linkage means coupled between said housing and said second jaw for urging said second jaw towards said fixed jaw, a portion of said linkage means comprising a portion of said handle for actuation of a gripping action by said jaws toward a locked position of said overcenter linkage means;

a lever having a cam, said lever being disposed within said housing for rotation alongside said overcenter linkage means, said cam being effective in at least one position of rotation of said lever to allow said overcenter linkage means to reach a locked position, a pivot point of said linkage means being moved from said locked position by said cam upon rotation of said lever for release of a force exerted by said jaws against said object; and a spring connecting said second jaw and a portion of said housing disposed away from said second jaw for separating said jaws upon displacement of said linkage means from said locked position by said cam and upon movement of said pin to raise said handle, said cam being effective in at least a second position of rotation to prevent said overcenter linkage means from reaching said locked position upon movement of said handle relative to said housing for actuation of a gripping action by said jaws, wherein said spring is in engagement with said cam for holding said cam in preferred positions of rotation.

2. A wrench according to claim 1 wherein said linkage comprises a rod pivotably connected to said handle, and a screw pivotably connected to said rod at a position spaced apart from the pivoting of said rod relative to said handle, said screw being adjustably positioned within said housing for advancement toward said fixed jaw for adjustment of a spacing between said jaws.

3. A wrench according to claim 1 wherein an edge of a surface in each jaw for contacting said object is configured as a portion of a hexagon, said object being a hexagonally shaped fastener.

4. A wrench according to claim 1 in which said second jaw has one end for gripping said object and has an opposite end into which said slot extends as an open-ended slot.

* * * * *